US009334135B2

(12) United States Patent
Grill et al.

(10) Patent No.: US 9,334,135 B2
(45) Date of Patent: May 10, 2016

(54) SHEET BRAKING DEVICE

(71) Applicant: BHS Corrugated Maschinen-und Anlagenbau GmbH, Weiherhammer (DE)

(72) Inventors: Martin Grill, Mantel (DE); Alfons Gnan, Vilseck (DE)

(73) Assignee: BHS Corrugated Maschinen-und Anlagenbau GmbH, Weiherhammer (DE)

( * ) Notice: Subject to any disclaimer, the term of this patent is extended or adjusted under 35 U.S.C. 154(b) by 0 days.

(21) Appl. No.: 14/448,067

(22) Filed: Jul. 31, 2014

(65) Prior Publication Data

US 2015/0033922 A1 Feb. 5, 2015

(30) Foreign Application Priority Data

Aug. 1, 2013 (DE) ..... 10 2013 215 068

(51) Int. Cl.
*B65H 7/18* (2006.01)
*B65H 3/34* (2006.01)
(Continued)

(52) U.S. Cl.
CPC .. *B65H 7/18* (2013.01); *B65H 3/34* (2013.01); *B65H 29/6618* (2013.01); *B65H 29/68* (2013.01); *B65H 2301/4474* (2013.01); *B65H 2301/44732* (2013.01); *B65H 2401/15* (2013.01); *B65H 2404/56* (2013.01);
(Continued)

(58) Field of Classification Search
CPC .... B65H 29/68; B65H 35/00; B65H 35/0006; B65H 35/04; B65H 7/18; B65H 3/34; B65H 29/6618; B65H 2404/6942; B65H 2301/44732; B65H 2701/1762; B65H 2401/15; B65H 2301/4474; B65H 2404/56; Y10T 83/202
USPC ..... 271/182
See application file for complete search history.

(56) References Cited

U.S. PATENT DOCUMENTS 5,060,928 A * 10/1991 Vits ..... B65H 31/24 271/182
5,437,749 A 8/1995 Pipkorn et al.
(Continued)

FOREIGN PATENT DOCUMENTS

DE 22 27 135 A1 12/1973
DE 43 05 158 A1 8/1994
(Continued)

OTHER PUBLICATIONS

Extended European Search Report of Jan. 6, 2015.

*Primary Examiner* — David H Bollinger
(74) *Attorney, Agent, or Firm* — McGlew and Tuttle, P.C.

(57) ABSTRACT

The invention relates to a sheet braking device for braking sheets transported in a transport direction. The sheet braking device comprises at least one holder, at least one sheet guide unit arranged adjacent to the at least one holder, and at least one sheet braking unit which is held by the at least one holder, is arranged adjacent to the at least one sheet guide unit, comprises at least one sheet braking body which has a first braking region to exert a braking force on the sheet to be braked, and comprises at least one second sheet braking body which has a second braking region to exert a braking force on the sheet to be braked. The at least one sheet braking unit is configured in such a way that in order to reduce the speed of the sheet, the first braking region and the second braking region are spaced from each other in the transport direction when acting upon the sheet to be braked.

17 Claims, 5 Drawing Sheets

(51) Int. Cl.
*B65H 29/68* (2006.01)
*B65H 29/66* (2006.01)

(52) U.S. Cl.
CPC . *B65H2404/6942* (2013.01); *B65H 2701/1762* (2013.01); *Y10T 83/202* (2015.04)

(56) References Cited

U.S. PATENT DOCUMENTS 5,632,850 A 5/1997 Knorr et al.
5,992,844 A 11/1999 Dillinger et al.
6,942,216 B1 * 9/2005 Koelle ..... B65H 1/22 271/182
7,178,800 B2 * 2/2007 Stauber ..... B65H 29/6609 271/182
8,079,587 B2 * 12/2011 Holzschneider ..... B65H 29/02 271/182
2006/0075864 A1 * 4/2006 Adami ..... B26D 7/2635 83/469
2009/0243197 A1 * 10/2009 Slemer Dos Santos ..... B65H 29/683 271/182
2013/0029825 A1 * 1/2013 Rich ..... B41J 3/543 493/324
2013/0068369 A1 * 3/2013 Mann ..... B32B 38/1841 156/64

FOREIGN PATENT DOCUMENTS

DE 44 35 212 A1 4/1995
DE 195 36 007 A1 4/1997
DE 198 24 694 A1 12/1999
EP 0 687 552 A2 12/1995
GB 1 389 942 A 4/1975
GB 1 305 675 A 4/1997
JP H0451459 U 4/1992

* cited by examiner

SHEET BRAKING DEVICE

CROSS-REFERENCE TO RELATED APPLICATIONS

This application claims the priority of Patent Application Serial No. DE 10 2013 215 068.7 filed on 1 Aug. 2013, pursuant to 35.U.S.C. 119(a)-(d), the content of which is incorporated herein by reference in its entirety as if fully set forth herein.

FIELD OF THE INVENTION

The invention relates to a sheet braking device for braking sheets, in particular sheets of corrugated cardboard, transported in a transport direction. The invention further relates to an installation for providing sheets, in particular sheets of corrugated cardboard, comprising at least one sheet braking device of this type. The invention further discusses a sheet braking unit, in particular a corrugated cardboard sheet braking unit, to be used in a sheet braking device.

BACKGROUND OF THE INVENTION

Prior art sheet braking units, which are for instance configured as spring plates, are known from prior public use. The braking effect or braking force of sheet braking units of this type is often not satisfactory. In many cases, the prior art sheet braking units are also formed by brushes which are provided with bristles. Nowadays, the bristles are usually configured as fibreglass bristles. These bristles are subject to increased wear.

SUMMARY OF THE INVENTION

An object of the invention is to provide a sheet braking device which provides an extremely high braking effect or braking force on the one hand while being particularly resistant to wear on the other. An installation comprising at least one sheet braking device of this type is to be provided as well. Another object of the invention is to provide a sheet braking unit which is extremely resistant to wear and provides a high braking effect or braking force.

According to the invention, these objects are achieved by a sheet braking device for braking sheets, in particular sheets of corrugated cardboard, transported in a transport direction, the sheet braking device comprising at least one holder; at least one sheet guide unit arranged adjacent to the at least one holder for guiding the sheets to be braked which are transported in the transport direction; and at least one sheet braking unit which is held by the at least one holder; is arranged adjacent to the at least one sheet guide unit; comprises at least one first sheet braking body which has a first braking region to exert a braking force on the sheet to be braked which is transported in the transport direction; and comprises at least one second sheet braking body which has a second braking region to exert a braking force on the sheet to be braked which is transported in the transport direction, wherein the at least one sheet braking unit is configured in such a way that when acting upon the sheet to be braked which is transported in the transport direction, the first braking region of the at least one first sheet braking body and the second braking region of the at least one second sheet braking body are spaced from each other in the transport direction during braking, by an installation for providing sheets, in particular sheets of corrugated cardboard, the installation comprising at least one cross-cutting unit for producing sheets from a web, in particular a web of corrugated cardboard, which is transported in a transport direction, and at least one sheet braking device according to the invention which is arranged downstream of the at least one cross-cutting unit in the transport direction, wherein the at least one sheet braking device is preferably arranged upstream of at least one sheet stacking device, and by a sheet braking unit, in particular a corrugated cardboard sheet braking unit, comprising at least one first sheet braking body which has a first braking region to exert a braking force on the sheet to be braked which is transported in the transport direction; and at least one second sheet braking body which has a second braking region to exert a braking force on the sheet to be braked which is transported in the transport direction, wherein the at least one sheet braking unit is configured in such a way that when acting upon the sheet to be braked which is transported in the transport direction, the first braking region of the at least one first sheet braking body and the second braking region of the at least one second braking body are spaced from each other in the transport direction during braking. The gist of the invention is that the at least one sheet braking unit comprises at least one first sheet braking body and at least one second sheet braking body which, in order to brake the sheet to be braked, simultaneously exert a braking force on the sheet to be braked in sheet positions or sheet regions that are spaced from each other when seen in the transport direction. Compared to conventional sheet braking devices, this increased braking region allows a greater braking effect to be applied to the webs to be braked.

Advantageously, a number of, in other words more than one, sheet braking units are arranged one behind the other in the transport direction.

The at least one sheet braking unit ideally presses the sheet to be braked against the sheet guide unit. Braking is then performed by friction.

Conveniently, the at least one sheet guide unit is formed by at least one table, at least one roller conveyor, at least one belt, at least one strap or the like.

The distance in the sheet braking device is advantageously adjustable between the at least one holder and the at least one sheet guide unit, thus allowing the sheet braking device for instance to be used for braking webs having different thicknesses while ensuring that the braking force of the at least one sheet braking unit is easily adjustable. Advantageously, in order to adjust the braking force, the at least one sheet braking unit is additionally or alternatively mounted to the at least one holder in such a way as to be displaceable or pivotable relative to the sheet to be braked. Alternatively, the at least one sheet braking unit is rigidly secured to the at least one holder.

The braking region is advantageously a free end region of the respective sheet braking body.

The at least one first sheet braking body and/or the at least one second braking body ideally extends across the width of the sheet to be braked by at least 50%, preferably by at least 70%, preferably by at least 90% when seen in a direction transverse to the transport direction.

The width of the at least one first sheet braking body and of the at least one second sheet braking body is ideally between 10 mm and 40 mm, preferably between 15 mm and 35 mm, at least in their braking regions. Preferably, the width is in each case constant and equal. Alternatively, the width changes at least in some regions.

The at least one first sheet braking body and/or the at least one second sheet braking body is/are preferably made of a metal material such as steel.

It is conceivable for the at least one sheet braking unit to be provided with at least one additional, in other words third, fourth, fifth, sheet braking body in addition to the at least one first sheet braking body and the at least one second braking body. The at least one additional sheet braking body preferably has a length that differs from that of the at least one first and second braking body. Otherwise its structure corresponds to the at least one first or second braking body. In its active state, the at least one additional sheet braking body acts upon the sheet to be braked in at least one additional sheet position which is spaced from the other positions of action of the first and second sheet braking bodies when seen in the transport direction.

The positions of action, in other words the braking positions created by each of the first and second sheet braking bodies when acting upon the sheet to be braked, are preferably linear. The at least one first sheet braking body preferably forms a first linear position of action or braking position on the sheet to be braked while the at least one second sheet braking body ideally forms a second linear position of action or braking position on the sheet to be braked. Consequently, the at least one sheet braking unit produces at least two position of actions or braking positions on the sheet to be braked which are spaced from each other in the transport direction and are preferably linear, extend preferably parallel to each other and are preferably transverse to the transport direction.

In an installation for providing sheets, the at least one sheet braking device allows the sheets to be transported or arranged in such a way as to overlap each other, which facilitates the formation of stacks.

The at least one cross-cutting unit of the installation for providing sheets, in particular sheets of corrugated cardboard, wherein the cross-cutting unit is provided for producing sheets from a web, in particular a web of corrugated cardboard, which is transported in a transport direction is preferably provided with a knife. A contactless cross-cutting device is conceivable as well.

The at least one sheet stacking device ideally has a height-adjustable table in order to receive the webs to be stacked.

The embodiment in which the at least one first sheet braking body and the at least one second sheet braking body are carried by a common carrier results in a sheet braking unit which is particularly user-friendly. The sheet braking bodies are thus combined in a unit or a package. It is advantageous if the at least one sheet braking unit is secured or mounted to the at least one holder via its support structure.

The embodiment in which the at least one second sheet braking body has a first length and the at least one second sheet braking body has a second length which is greater than the first length ensures a fail-safe contact between the first and second braking regions and the sheet positions or sheet regions which are spaced from each other along the sheet to be braked when seen in the transport direction. Each of the first and second lengths is preferably measured from the end of the corresponding common carrier.

The length of the at least one first sheet braking body advantageously amounts to between 40% and 80%, preferably between 50% and 70%, of the length of the at least one second sheet braking body.

The at least one second sheet braking body advantageously has a length which is between 200 mm and 700 mm, preferably between 280 mm and 500 mm.

The arrangement according to which the at least one second sheet braking body is arranged downstream of the at least one first sheet braking body in the transport direction provides a particularly high braking force in order to reduce the speed of the sheet.

The sheet braking device which is configured such that in its inactive state, the at least one first sheet braking body is disposed in a first plane while the at least one second sheet braking body is disposed in a second plane, wherein the second plane is parallel to the first plane, is extremely compact and space-saving when the sheet braking bodies are in the inactive, in other words the non-braking state.

The embodiment in which the at least one first sheet braking body and the at least one second sheet braking body abut against each other at least partly in the transport direction when they are in their respective inactive states results in a space-saving, in other words compact arrangement as well. Alternatively, the at least one first sheet braking body and the at least one second sheet braking body are spaced from but arranged adjacent to each other in the transport direction.

In a preferred embodiment, the at least one first sheet braking body and/or the at least one second sheet braking body has/have an elongated design. Preferably, the at least one first sheet braking body and/or the at least one second sheet braking body is/are configured in the manner of lamellas or bars. It is advantageous if each of the at least one first sheet braking body and/or the at least one second braking body extends/extend from the common carrier to the sheet to be braked in a longitudinal direction. A platelike design is alternatively conceivable as well.

In a preferred embodiment, the at least one first sheet braking body and/or the at least one second sheet braking body is/are resilient, in other words they provide a spring effect or are able to produce a spring force. Preferably, the at least one first sheet braking body and/or the at least one second sheet braking body are/is made of spring steel.

In a preferred embodiment, the at least one first sheet braking body and the at least one second sheet braking body are at least partially deflectable relative to each other. It is advantageous if for instance the amount of maximum deflection relative to each other is a function of the contact force applied to the sheet to be braked by the sheet braking bodies. The maximum amount of relative deflection is ideally also a function of respective longitudinal extension of the sheet braking bodies in the direction of the sheet to be braked. The at least one first sheet braking body and the at least one second sheet braking body are preferably deflectable relative to each other between an inactive non-braking position and an active braking position. The non-braking position is preferably a non-deflected rest position while in the braking position, the at least one first and/or second sheet braking body is deflected relative to the rest position. The at least one first sheet braking body and/or the at least one second sheet braking body ideally has/have the tendency to return to its/their rest position.

The sheet braking body/bodies which has/have a rectangular cross-section at least in its/their first and/or second braking region is/are extremely easy to produce, for instance by punching.

In a preferred embodiment, the at least one first sheet braking body and the at least one second sheet braking body differ in terms of their geometrical moments of inertia and/or their section moduli. In other words, they differ in terms of their resistance to stress, in particular to bending. They also differ in terms of their rigidity, in particular with respect to bending or folding stresses. Alternatively, the at least one first sheet braking body and the at least one second braking body have identical geometrical moments of inertia and/or section moduli.

The embodiment in which the at least one sheet braking unit is provided with a first plurality of first sheet braking bodies which are arranged adjacent to each other in a first row extending perpendicularly or obliquely to the transport direction and/or a second plurality of second sheet braking bodies which are arranged adjacent to each other in a second row extending perpendicularly or obliquely to the transport direction allows a sheet braking device to be obtained which is extremely fail-safe and provides a particularly high braking effect.

The first braking regions of the first sheet braking bodies are advantageously adjacent to but laterally spaced apart from each other. Furthermore, the second braking regions of the second sheet braking bodies are ideally adjacent to but laterally spaced apart from each other as well. Conveniently, the first sheet braking bodies are identical to each other. The second sheet braking bodies are advantageously identical to each other as well.

The first sheet braking bodies are advantageously deformable or deflectable separately from each other. Ideally, at least five, preferably at least ten, second sheet braking bodies are provided.

Conveniently, the number of first sheet braking bodies is identical to the number of second sheet braking bodies.

Preferably, the first sheet braking bodies are mounted in the respective support structure individually and separately from each other. Preferably, the second sheet braking bodies are mounted in the respective support structure individually and separately from each other. Alternatively, the first sheet braking bodies are interconnected in the support structure via a cross-bar which is in turned secured to the support structure. Alternatively, the second sheet braking bodies are interconnected in the support structure via a cross-bar which is in turned secured to the support structure.

Conveniently, the first plurality of first sheet braking bodies substantially forms a first linear position of action or braking position on the sheet to be braked while the second plurality of second sheet braking bodies substantially forms a first linear position of action or braking position on the sheet to be braked. The first and second positions of action are parallel to each other and extend in a direction transverse to the transport direction.

Conveniently, the supply devices for supplying first and second material webs are in each case configured as unwinding devices which may be part of a splice arrangement. The device for producing single-face laminated corrugated cardboard preferably comprises at least one corrugating roller for producing corrugations in one of the material webs, and a joining device for joining the corrugated material web to the other smooth material web.

The first and second material webs are ideally configured as endless material webs. These material webs are preferably made of a paper or cardboard material.

A preferred embodiment of the invention will be described by way of example with reference to the attached drawing.

DESCRIPTION OF THE PREFERRED EMBODIMENT

Figure 1:
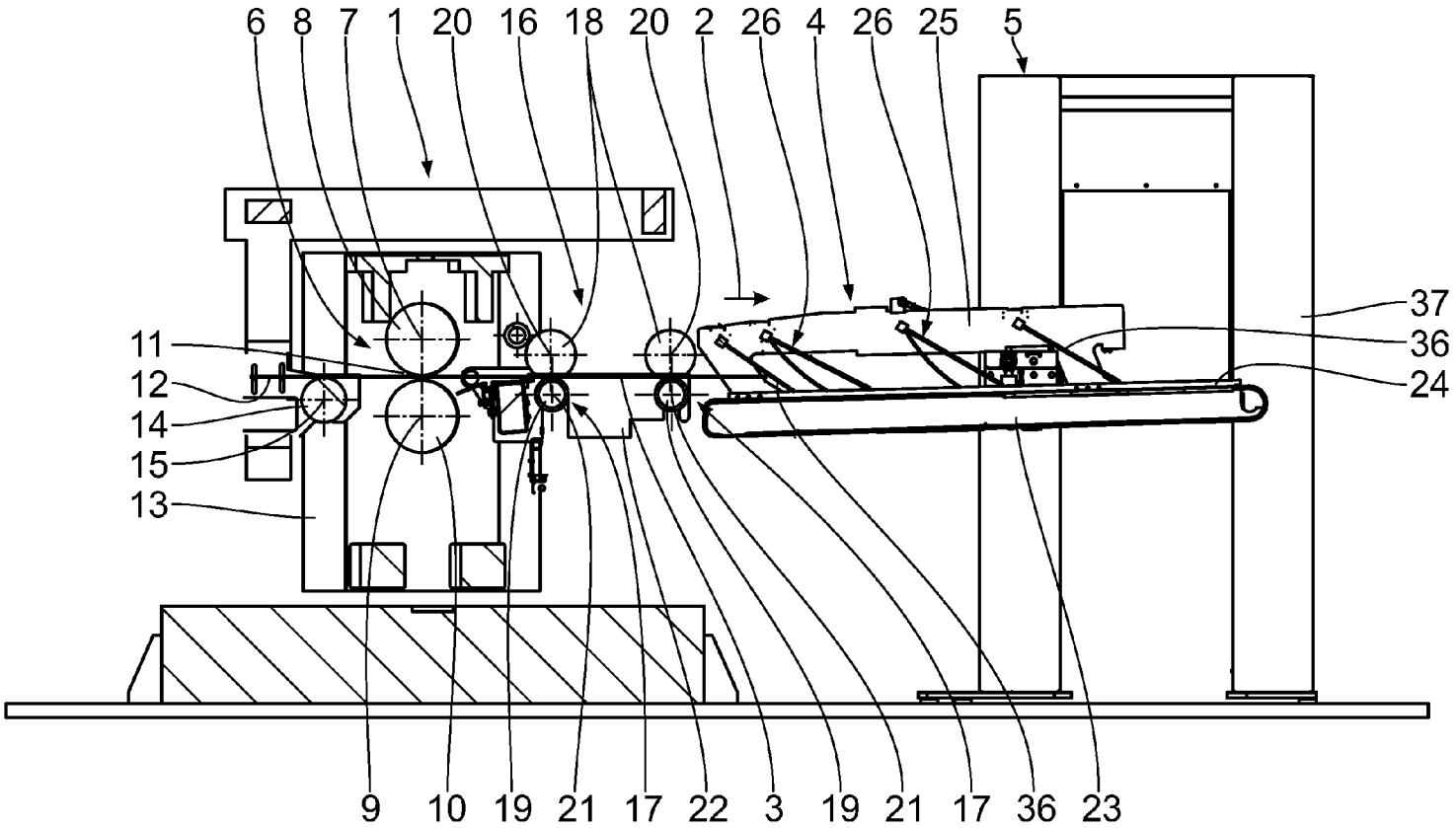
FIG. 1 shows a schematic side view of an installation according to the invention for providing sheets which includes a sheet braking device according to the invention.
Figure 3:
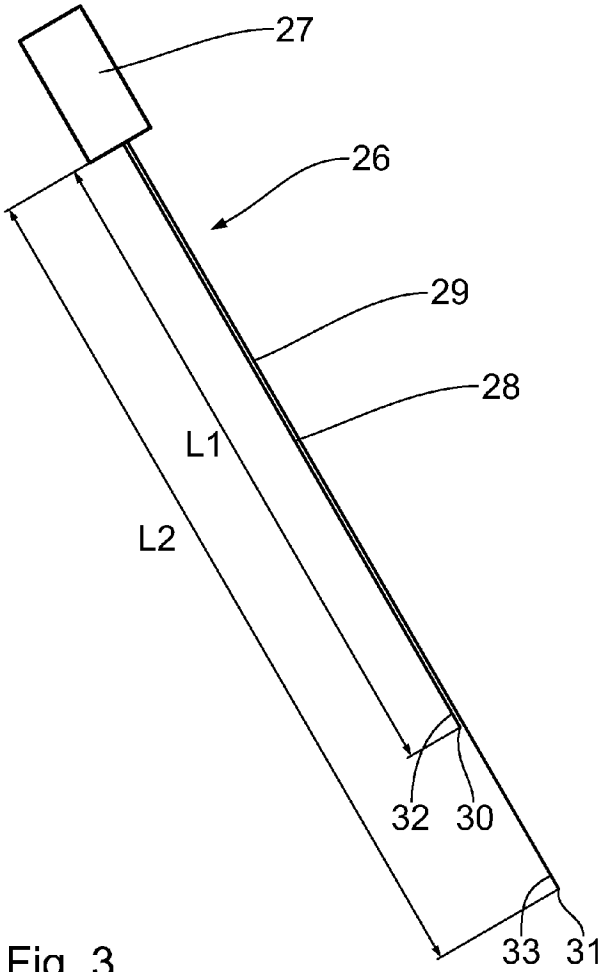
FIG. 3 shows a simplified side view of a sheet braking device shown in FIGS. 1 and 2 which is in an inactive non-braking state.
Figure 2:
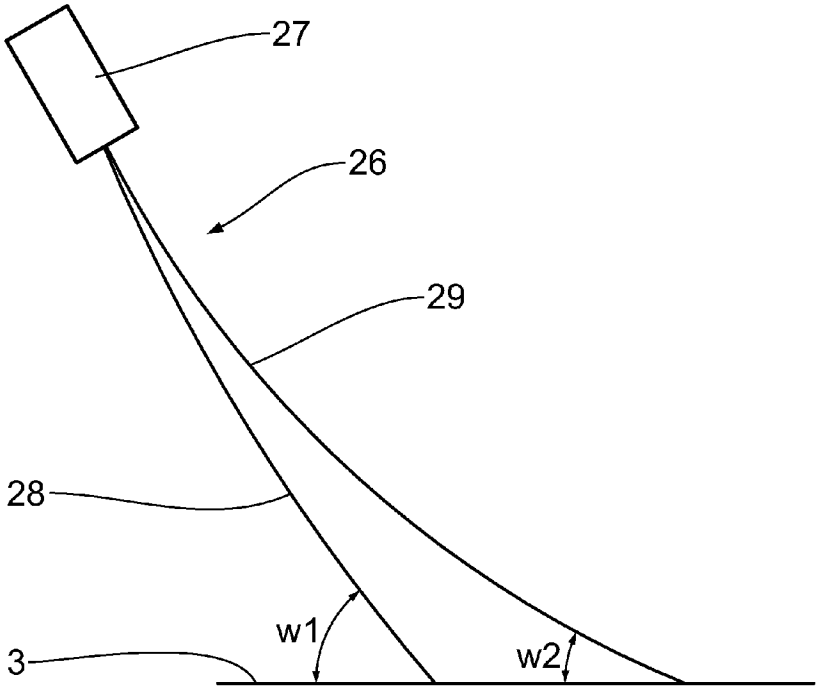
FIG. 2 shows a schematic side view of a sheet braking device shown in FIG. 1, wherein the sheet braking bodies thereof exert a braking force on a sheet to be braked.
Figure 4:
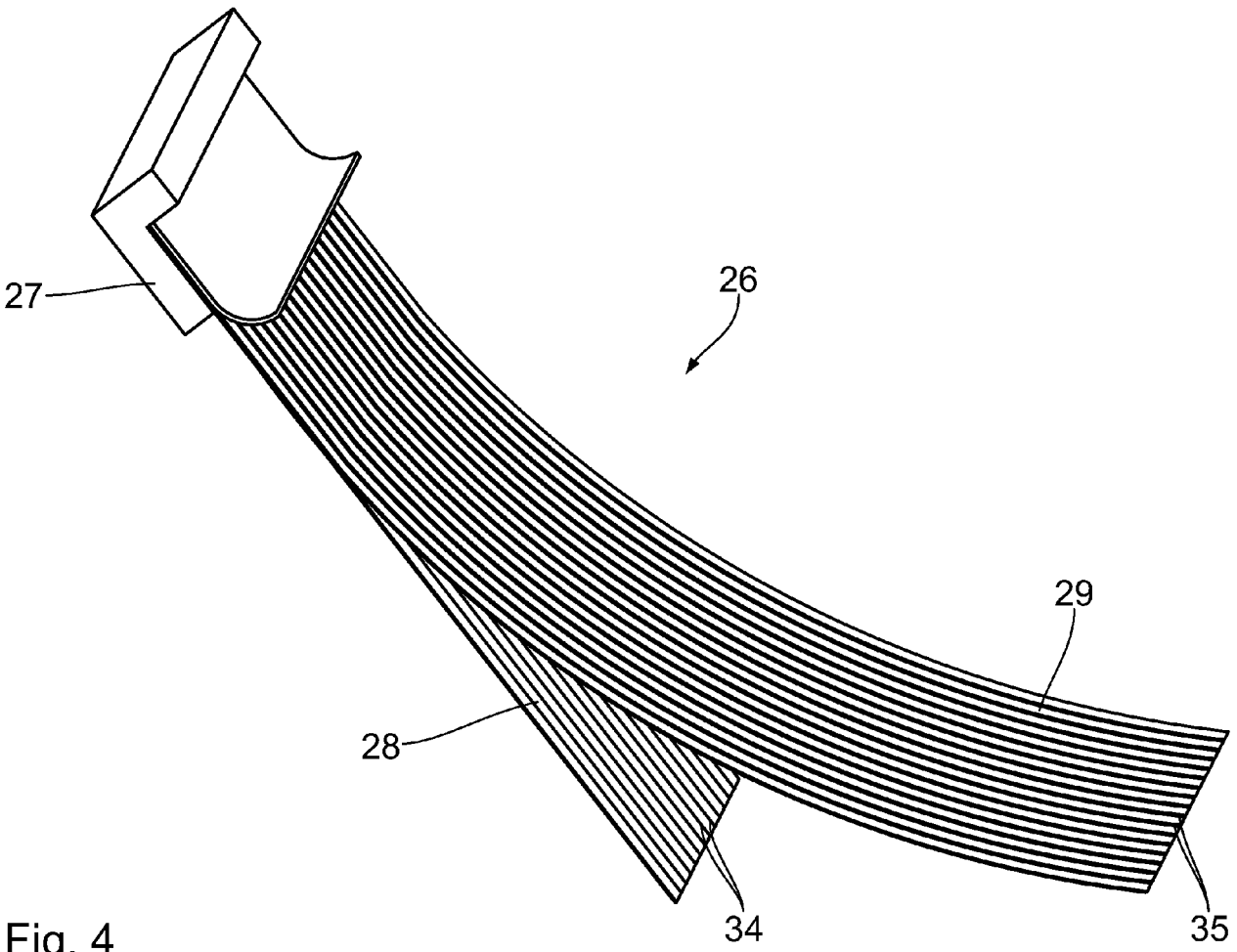
FIG. 4 shows a perspective view of the sheet braking device shown in FIG. 2.
Figure 5:
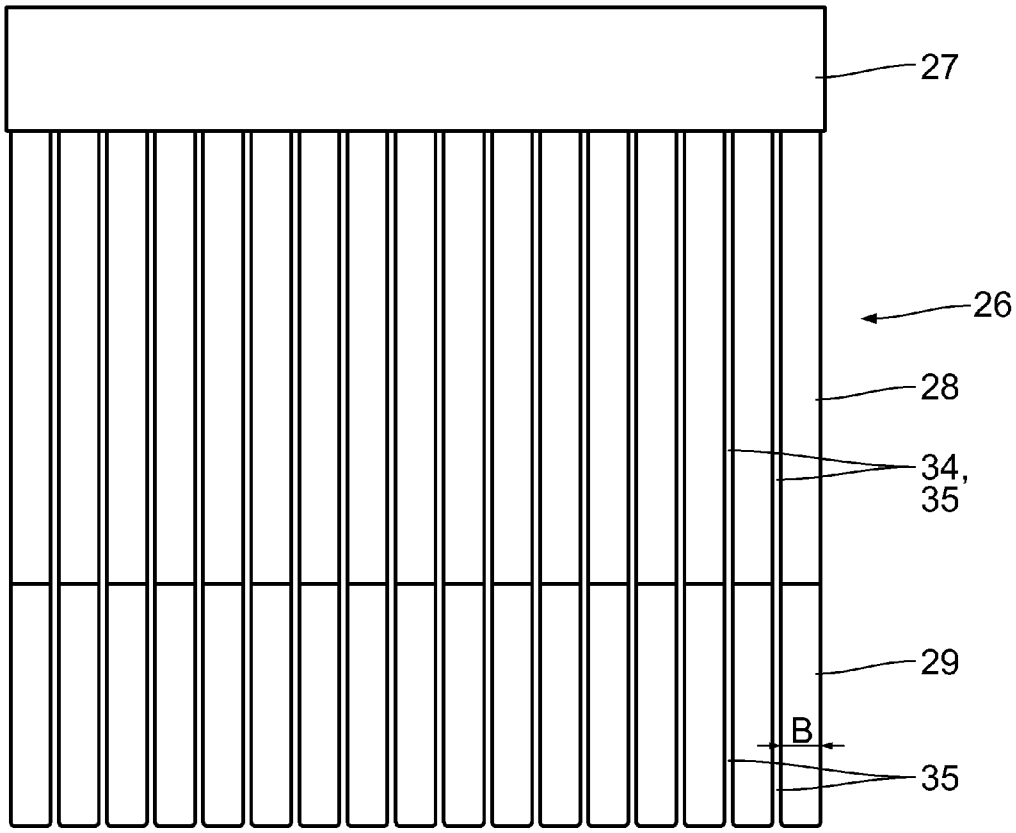
FIG. 5 shows a front view of the sheet braking device shown in FIG. 3.
Figure 6:
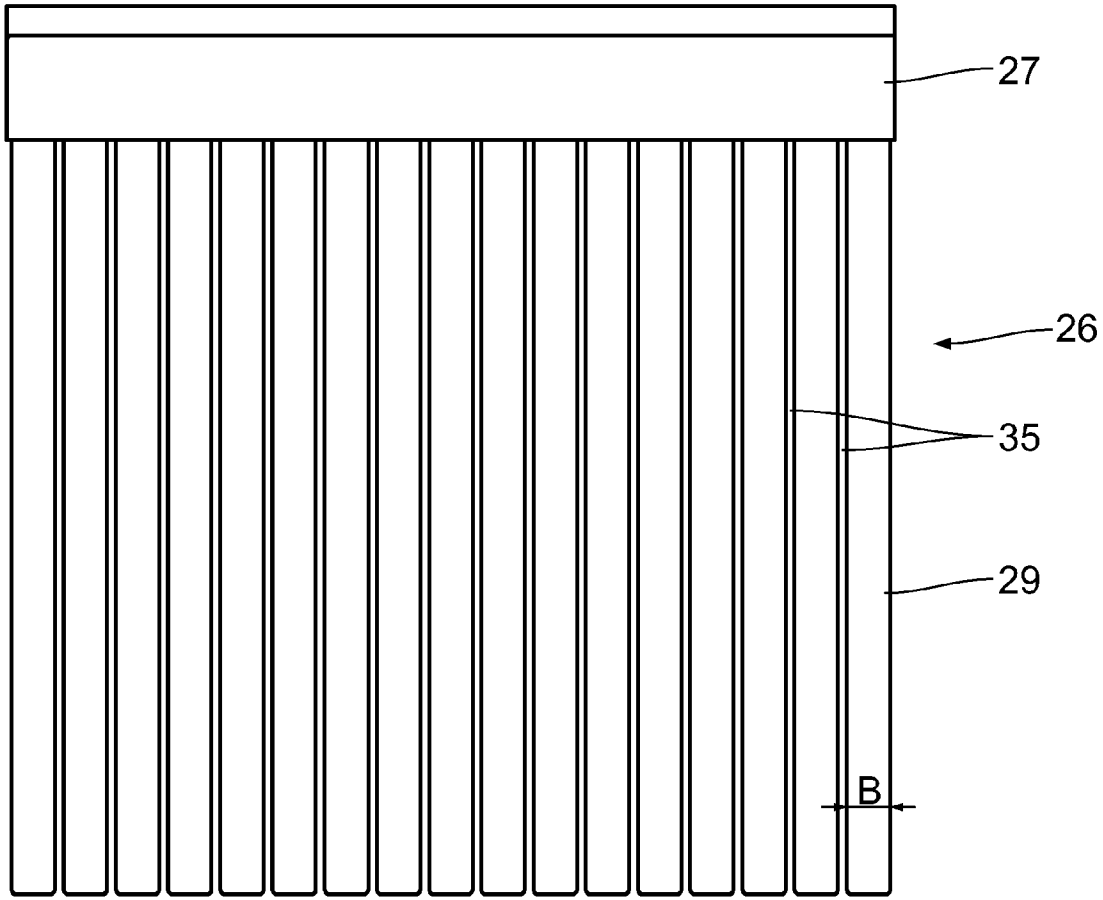
FIG. 6 shows a rear view of the sheet braking device shown in FIGS. 3 and 5.

The installation shown in FIG. 1 comprises a cross-cutting unit 1, a sheet braking device 4 arranged downstream of the cross-cutting unit 1 in a transport direction 2 of a sheet 3 that is transported, and a sheet stacking device 5 arranged downstream of the sheet braking device 4 in the transport direction 2. In other words, the sheet braking device 4 is arranged between the cross-cutting unit 1 and the sheet stacking device 5. The expressions "upstream" and "downstream" used throughout this disclosure are in each case relative to the transport direction 2.

The cross-cutting unit 1 comprises a pair 6 of cross-cutting rollers which comprises an upper cross-cutting roller 8 that is drivable for rotation about an axis of rotation 7, and a lower cross-cutting roller 10 that is drivable for rotation about an axis of rotation 9. The axes of rotation 7, 9 are parallel to each other and perpendicular to the transport direction 2. Between the upper cross-cutting roller 8 and the lower cross-cutting roller 10, there is a roller gap 11 through which a web 12 of corrugated cardboard is or may be passed.

Each cross-cutting roller 8, 10 carries a knife (not shown) which extends in the radial outward direction and perpendicularly to the transport direction 2. The knives of the pair 6 of cross-cutting rollers interact in such a way as to cross-cut the web 12 of corrugated cardboard, causing the sheets 3 to be produced from the web 12 of corrugated cardboard. Downstream of the pair 6 of cross-cutting rollers, the web 12 of corrugated cardboard has been cut into sheets 3.

The upper cross-cutting roller 8 and the lower cross-cutting roller 10 are mounted in a frame 13.

The cross-cutting unit 1 is further provided with an infeed roller 14 arranged upstream of the pair 6 of cross-cutting rollers which infeed roller 14 is mounted for rotation in the frame 13 or in such a way as to be drivable for rotation about an axis of rotation 15. The axis of rotation 15 is parallel to the axes of rotation 7, 9.

The cross-cutting unit 1 is further provided with an outlet 16 which is arranged downstream of the pair 6 of cross-cutting rollers. The outlet 16 is formed by two pairs 17 of transport rollers which are spaced from each other when seen in the transport direction 2. Each pair 17 of transport rollers 17 has two transport rollers 18, 19 with axes of rotation 20 or 21, respectively, which are parallel to each other and parallel to the axes of rotation 7, 9, 15. Between the pairs 17 of transport rollers, the sheets 3 are guided for displacement along a table 22.

The sheet braking device 4 has a sheet guide unit 23 with a guide support surface 24 facing upwards which essentially extends horizontally in the transport direction 2. The sheet guide unit 23 is configured in the manner of a table.

Above the sheet guide unit 23, a holder 25 extends in the transport direction 2. Two sheet braking units 26 are mounted to the holder 25, which sheet braking units 26 are identical and spaced from each other in the transport direction 2. The sheet braking units 26 are preferably mounted to the holder 25 in such a way as to be pivotable.

As shown in FIGS. 2 to 6 as well, each sheet braking unit 26 has an upper carrier 27 and a plurality of first and second sheet braking bodies 28 or 29 secured to the carrier 27. The carrier 27 extends perpendicularly to the transport direction 2. The first sheet braking bodies 28 are arranged adjacent to each other in the carrier 27 in such a way as to be spaced from each other. Furthermore, the second sheet braking bodies 29 are arranged adjacent to each other in the carrier 27 so as to be spaced from each other as well. The first sheet braking bodies 28 are arranged in a finger-like configuration. The second sheet braking bodies 29 are arranged in a finger-like configuration as well. Each of the first and second sheet braking bodies 28 and 29 extends perpendicularly from the carrier 27 in a direction towards the sheet 3 to be braked.

Starting from the carrier 27, the first sheet braking bodies 28 have in each case a first identical length L1 while the second sheet braking bodies 29 have in each case a second identical length L2. The first sheet braking bodies 28 are shorter than the second sheet braking bodies 29. Each of the first sheet braking bodies 28 has a first free end 30 while each of the second sheet braking bodies 29 has a free second end 31. Each of the first ends 30 forms a first braking region 32 together with portions which may be provided adjacent thereto while each of the second ends 31 forms a second braking region 33 together with portions which may be provided adjacent thereto.

Each of the first and second sheet braking bodies 28, 29 has a width B which is perpendicular to its longitudinal extension and remains constant along the longitudinal extension. The widths B of the first sheet braking bodies 28 and those of the second sheet braking bodies 29 are in each case identical. The width B is considerably shorter than the length L1 or L2.

Each of the first sheet braking bodies 28 and the second sheet braking bodies 29 of one sheet braking unit 26 has an identical constant cross-section which is preferably an elongated rectangular cross-section that extends in a longitudinal direction perpendicularly to the transport direction 2.

The first sheet braking bodies 28 and the second sheet braking bodies 29 are arranged in such a way as to cover or overlap each other when they are in their inactive state. In a direction perpendicular to the transport direction 2, the sheet braking bodies 28, 29 of a respective sheet braking unit 26 are in other words not staggered relative to each other.

In each sheet braking unit 26, the first sheet braking bodies 28 are arranged upstream of the second sheet braking bodies 29. In the unloaded, in other words inactive state, the first sheet braking bodies 28 are in a surface-to-surface contact with the second sheet braking bodies 29 arranged adjacent thereto along the entire first length L1. In the unloaded, in other words inactive state, the first sheet braking bodies 28 are arranged in a first plane while the second sheet braking bodies 29 are then arranged in a second plane which is parallel to the first plane.

In their active state, the sheet braking units 26 are inclined relative to the sheet 3 to be braked in such a way that each of the first and second sheet braking bodies 28 and 29 forms a first angle w1 or a second angle w2, respectively, with the sheet 3 to be braked. The angle w1 is greater than the angle w2. The angle w1 is preferably between 40° and 60° while the angle w2 is preferably between 20° and 40°. Starting from the carriers 27, the sheet braking units 26 extend at an angle from top to bottom when seen in the transport direction 2.

Between the first sheet braking bodies 28, there is in each case a first separation gap 34 while there is in each case a second separation gap 35 between the second sheet braking bodies 29. The first and second separation gaps 34 and 35 are in each case constant and identical to each other.

The first sheet braking bodies 28 are deflectable or deformable separately from each other. The second sheet braking bodies 29 are deflectable or deformable separately from each other as well. The first sheet braking bodies 28 and the second sheet braking bodies 29 are deflectable or deformable separately from each other as well.

The holder 25 is provided with a conventional sheet braking unit which is in each case arranged upstream and downstream of the sheet braking units 26 and is, in contrast to the sheet braking units 26, only provided with second sheet braking bodies 29.

The sheet stacking device 5 has a frame 37 in which a two-dimensional, height-adjustable sheet deposit station (not shown) is arranged.

The following is a more detailed description of the functioning of the installation, in particular of the sheet braking device 4.

A first material web is wound off a first unwinding device while a second material web is wound off a second unwinding device. The first and the second webs of material are moved into an installation for the production of single-face laminated corrugated cardboard. In order to produce corrugations, the first material web is passed through two corrugating rollers of the installation which are arranged adjacent to each other in order to produce single-face laminated corrugated cardboard so that a corrugated web is obtained after the first material web has passed through the corrugating rollers.

Afterwards, glue is applied to the corrugated web in a gluing unit allowing the corrugated web to be glued to the second smooth material web. A unit of this type is for instance known from EP 0 687 552 A1 (corresponding to U.S. Pat. No. 5,632,850), from DE 195 36 007 A1 (corresponding to GB 2,305,67 A) or from DE 43 05 158 A1 to which reference is made for further details.

The single-face laminated web 12 of corrugated cardboard thus produced, which consists of the first material web and the second material web, is then moved into the cross-cutting unit 1. The web 12 of corrugated cardboard is moved through the roller gap 11 where the web 12 of corrugated cardboard is cut by the knives of the cross-cutting rollers 8, 10 to form the individual sheets 3. The sheets 3 are then moved along the table 22 by the transport rollers 18, 19 up to the sheet braking device 4.

In the sheet braking device 4, the sheets 3 are braked and conveyed at a slower speed in such a way as to overlap each other. A sheet 3 entering the sheet braking device 4 comes into contact with the upstream sheet braking unit 26 at first before coming into contact with the sheet braking unit 26 arranged downstream thereof in the transport direction 2. The speed of the sheet 3 has reduced already upon reaching the downstream sheet braking unit 26.

In the sheet braking units 26, the sheet 3 encounters the first sheet braking bodies 28 at first before encountering the sheet braking bodies 29 arranged downstream thereof. The first and second sheet braking bodies 28, 29 may in each case be curved to different extents, which also depends on the contact force acting on the sheet 3 to be braked. As becomes evident from FIG. 1, the second sheet braking bodies 29 are curved to a greater extent than the first sheet braking bodies 28 which substantially extend two-dimensionally.

The first and second braking regions 32 and 33 are in each case spaced from each other in the transport direction 2 and apply a pressure to the sheet 3 to be braked from above, causing the sheet 3 to be pressed against the guide support surface 24 from above so as to be braked by friction.

Arranged such as to overlap each other, the sheets 3 are then deposited on the sheet deposit station such as to form a stack.

It is advantageous if the first and second sheet braking bodies 28, 29 of the sheet braking device 26 arranged adjacent to the cross-cutting unit 1 or the outlet 16, respectively, are in each case shorter than the sheet braking bodies 28, 29 of the sheet braking device/s 26 arranged downstream thereof. It is particularly preferred if the first sheet braking body 28 of the sheet braking device 26 arranged adjacent to the cross-cutting unit 1 or the outlet 16, respectively, is shorter than the first sheet braking body 28 of the sheet braking device/s 26 arranged downstream thereof. If is particularly preferred if the second sheet braking body 29 of the sheet braking device 26 arranged adjacent to the cross-cutting unit 1 or the outlet 16, respectively, is shorter than the second sheet braking body 29 of the sheet braking device/s 26 arranged downstream thereof. This allows an even braking force to be applied to the sheet 3 to be braked.

What is claimed is:

1. A sheet braking device for braking sheets transported in a transport direction, the sheet braking device comprising:

at least one holder;

at least one sheet guide unit arranged adjacent to the at least one holder for guiding the sheets to be braked which are transported in the transport direction; and at least one sheet braking unit which is held by the at least one holder, said at least one sheet braking unit being arranged adjacent to the at least one sheet guide unit, said at least one sheet braking unit comprising at least one first sheet braking body, which has a first braking region to exert a braking force on the sheet to be braked which is transported in the transport direction, said at least one sheet braking unit comprising at least one second sheet braking body, which has a second braking region to exert a braking force on the sheet to be braked which is transported in the transport direction, wherein the at least one sheet braking unit is configured in such a way that when acting upon the sheet to be braked which is transported in the transport direction, the first braking region of the at least one first sheet braking body and the second braking region of the at least one second sheet braking body are spaced from each other in the transport direction during braking, wherein the at least one first sheet braking body has a first length, and the at least one second sheet braking body has a second length which is greater than the first length.

2. A sheet braking device according to claim 1, wherein the sheets are sheets of corrugated cardboard.

3. A sheet braking device according to claim 1, wherein the at least one first sheet braking body and the at least one second sheet braking body are carried by a common carrier.

4. A sheet braking device according to claim 1, wherein the at least one second sheet braking body is arranged downstream of the at least one first sheet braking body in the transport direction.

5. A sheet braking device according to claim 1, wherein the at least one first sheet braking body is disposed in a first plane in its inactive state while the at least one second sheet braking body is disposed in a second plane in its inactive state, wherein the second plane is parallel to the first plane.

6. A sheet braking device according to claim 1, wherein in their inactive states, the at least one first sheet braking body and the at least one second sheet braking body abut against each other at least partly in the transport direction.

7. A sheet braking device according to claim 1, wherein at least one of a group comprising the at least one first sheet braking body and the at least one second sheet braking body has an elongated design.

8. A sheet braking device according to claim 1, wherein at least one of a group comprising the at least one first sheet braking body and the at least one second sheet braking body is resilient.

9. A sheet braking device according to claim 1, wherein the at least one first sheet braking body and the at least one second sheet braking body are at least partly deflectable relative to each other.

10. A sheet braking device according to claim 1, wherein at least one of a group comprising the at least one first sheet braking body and the at least one second sheet braking body has a rectangular cross-section in at least one of a group comprising their first and second braking regions.

11. A sheet braking device according to claim 1, wherein the at least one first sheet braking body and the at least one second sheet braking body differ in terms of at least one of a group comprising their geometrical moments of inertia and their section moduli.

12. A sheet braking device according to claim 1, wherein the at least one sheet braking unit is provided with at least one of a group comprising a first plurality of first sheet braking bodies which are arranged adjacent to each other in a first row extending perpendicularly or obliquely to the transport direction, and a second plurality of second sheet braking bodies which are arranged adjacent to each other in a second row extending perpendicularly or obliquely to the transport direction.

13. A sheet braking unit, comprising:

at least one first sheet braking body which has a first braking region to exert a braking force on the sheet to be braked which is transported in the transport direction; and at least one second sheet braking body which has a second braking region to exert a braking force on the sheet to be braked which is transported in the transport direction, wherein the at least one sheet braking unit is configured in such a way that when acting upon the sheet to be braked which is transported in the transport direction, the first braking region of the at least one first sheet braking body and the second braking region of the at least one second braking body are spaced from each other in the transport direction during braking, wherein the at least one first sheet braking body has a first length, and the at least one second sheet braking body has a second length which is greater than the first length.

14. A sheet braking unit according to claim 13, wherein it is configured as a corrugated cardboard sheet braking unit.

15. A sheet braking device for braking sheets transported in a transport direction, the sheet braking device comprising:

at least one holder;

at least one sheet guide unit arranged adjacent to the at least one holder for guiding the sheets to be braked which are transported in the transport direction; and at least one sheet braking unit which is held by the at least one holder, said at least one sheet braking unit being arranged adjacent to the at least one sheet guide unit, said at least one sheet braking unit comprising at least one first sheet braking body, which has a first braking region to exert a braking force on the sheet to be braked which is transported in the transport direction, said at least one sheet braking unit comprising at least one second sheet braking body, which has a second braking region to exert a braking force on the sheet to be braked which is transported in the transport direction, wherein the at least one sheet braking unit is configured in such a way that when acting upon the sheet to be braked which is transported in the transport direction, the first braking region of the at least one first sheet braking body and the second braking region of the at least one second sheet braking body are spaced from each other in the transport direction during braking, wherein the at least one first sheet braking body and the at least one second sheet braking body differ in terms of at least one of a group comprising their geometrical moments of inertia and their section moduli.

16. A sheet braking device for braking sheets transported in a transport direction, the sheet braking device comprising:

at least one holder;

at least one sheet guide unit arranged adjacent to the at least one holder for guiding the sheets to be braked which are transported in the transport direction; and at least one sheet braking unit which is held by the at least one holder, said at least one sheet braking unit being arranged adjacent to the at least one sheet guide unit, said at least one sheet braking unit comprising at least one first sheet braking body, which has a first braking region to exert a braking force on the sheet to be braked which is transported in the transport direction, said at least one sheet braking unit comprising at least one second sheet braking body, which has a second braking region to exert a braking force on the sheet to be braked which is transported in the transport direction, wherein the at least one sheet braking unit is configured in such a way that when acting upon the sheet to be braked which is transported in the transport direction, the first braking region of the at least one first sheet braking body and the second braking region of the at least one second sheet braking body are spaced from each other in the transport direction during braking, wherein in their inactive states, the at least one first sheet braking body and the at least one second sheet braking body abut against each other at least partly in the transport direction.

17. A sheet braking unit, comprising:

at least one first sheet braking body which has a first braking region to exert a braking force on the sheet to be braked which is transported in the transport direction; and at least one second sheet braking body which has a second braking region to exert a braking force on the sheet to be braked which is transported in the transport direction, wherein the at least one sheet braking unit is configured in such a way that when acting upon the sheet to be braked which is transported in the transport direction, the first braking region of the at least one first sheet braking body and the second braking region of the at least one second braking body are spaced from each other in the transport direction during braking, wherein in their inactive states, the at least one first sheet braking body and the at least one second sheet braking body abut against each other at least partly in the transport direction.

* * * * *